US005094404A

United States Patent [19]

DesRosiers et al.

[11] Patent Number: 5,094,404

[45] Date of Patent: Mar. 10, 1992

[54] DYE SPRING ELONGATED MEMBRANE DESIGN

[75] Inventors: Victor J. DesRosiers, Kinderhook, N.Y.; Alvin D. Thomas, Pittsfield, Mass.; Brian Couchey, Chatham, N.Y.; Garner Pruitt, Greer, S.C.

[73] Assignee: Crellin, Inc., Chatham, N.Y.

[21] Appl. No.: 700,620

[22] Filed: May 15, 1991

[51] Int. Cl.[5] ..... B65H 75/20

[52] U.S. Cl. ..... 242/118.11; 68/198

[58] Field of Search ..... 68/198; 242/118.1, 118.11, 242/118.2

[56] References Cited

U.S. PATENT DOCUMENTS

| | | | |
|---|---|---|---|
| 3,647,156 | 3/1972 | Henning | 242/118.1 |
| 4,181,274 | 1/1980 | Burchette, Jr. | 242/118.11 |
| 4,454,734 | 6/1984 | Marquis et al. | 68/198 |
| 4,621,508 | 11/1986 | Baxley, Jr. et al. | 68/198 |
| 4,823,565 | 4/1989 | Hahm | 68/198 |
| 4,872,621 | 10/1989 | Thomas | 242/118.11 |
| 4,941,621 | 7/1990 | Pasini | 242/118.1 |
| 4,946,114 | 8/1990 | Becker et al. | 68/198 X |
| 4,962,650 | 10/1990 | Hahm | 68/198 |

*Primary Examiner*—Philip R. Coe

*Attorney, Agent, or Firm*—Kane, Dalsimer, Sullivan, Kurucz, Levy, Eisele, and Richard

[57] ABSTRACT

A spring dye tube for use in dyeing textile yarns has a generally open-ended, cylindrical configuration with a latticed side wall. It is resiliently compressible in a longitudinal direction, and includes longitudinal stabilizing elements to prevent growth or collapse during high-speed winding operations. In turn, these longitudinal stabilizing elements buckle and collapse when the spring dye tube as a whole is compressed in a longitudinal direction. The longitudinal stabilizing elements may be disposed in pairs separated by a gap, or singly. In the latter case, a longitudinal groove may be provided along the length of the element; the element will split along this groove when the tube is compressed. In either case, this provides a means for dye to pass through that portion of the tube during use in a dyeing operation. The longitudinal stabilizing elements can resemble thin membranes in appearance, the membranes being of greater width than thickness. In yet another case, the longitudinal stabilizing element may cover the entire inner surface of a spring dye tube. The longitudinal stabilizing elements may be incorporated in helical, and other kinds of, spring dye tubes known in the art.

25 Claims, 6 Drawing Sheets

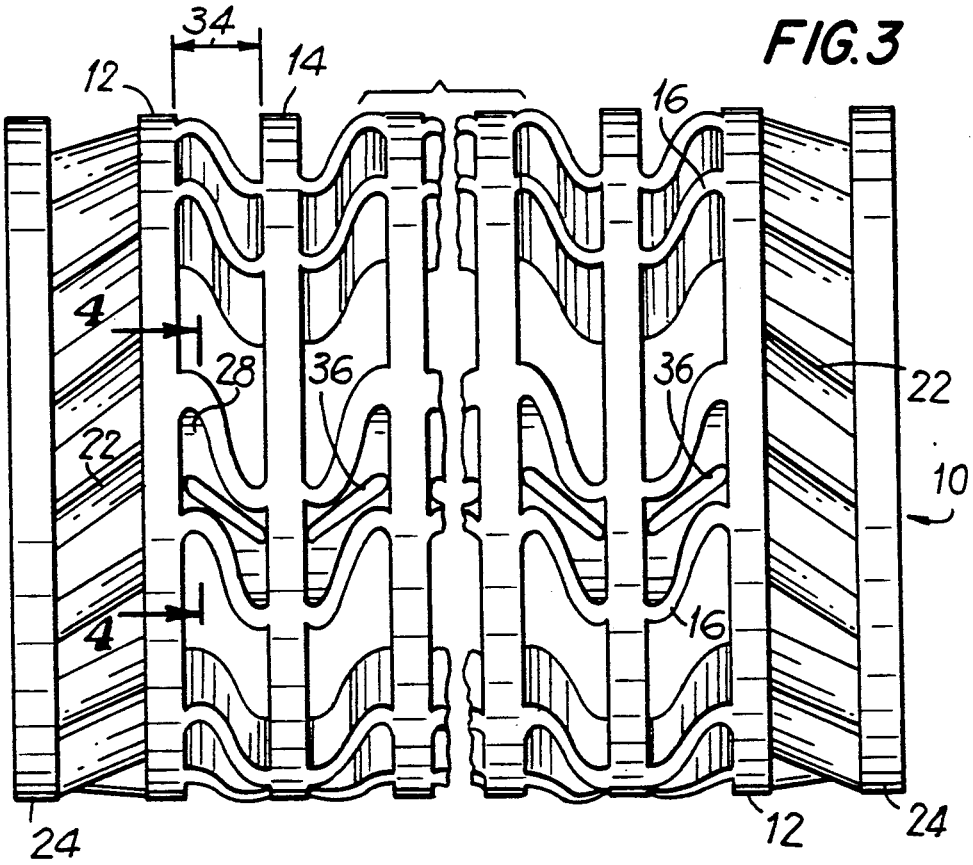
FIG. 3
FIG. 4
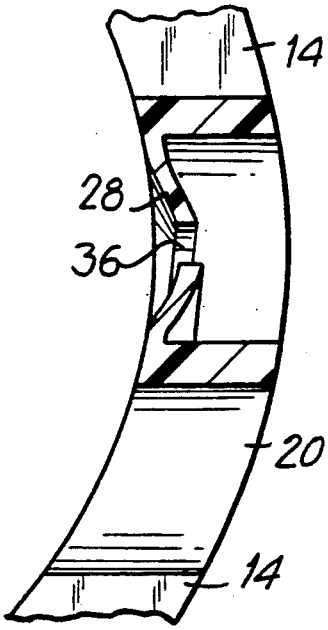
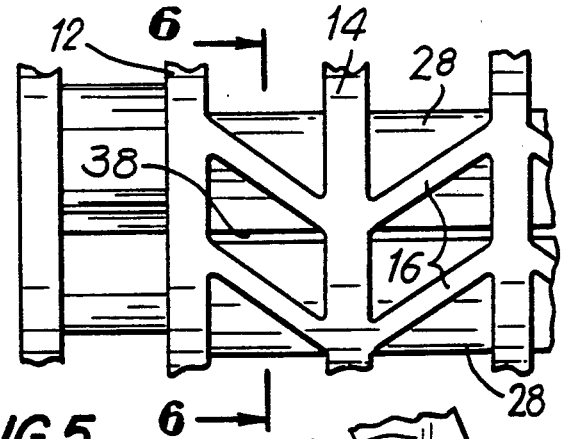
FIG. 5
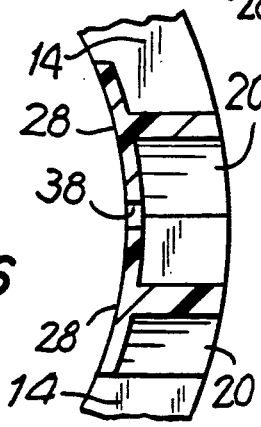
FIG. 6

DYE SPRING ELONGATED MEMBRANE DESIGN

BACKGROUND OF THE INVENTION

1. Field of the Invention

This invention relates generally to spring dye tubes which are cylindrical in shape and resiliently compressible in the axial direction. Although open-ended, the side cylindrical surface of the spring dye tubes of the present invention is an open latticework of transverse and axial, or substantially axial, or of helical and axial, members. These members serve as carrier elements upon which yarn is wound for dyeing. The edges of the ends of the spring dye tubes are perpendicular to the side cylindrical surfaces, so that the tubes can be stacked one atop the next during the dyeing process.

2. Description of the Prior Art

Spring dye tubes are used as cores onto which textile yarn is wound for dyeing. In use, the tubes are placed on dye spindles or the like in pressurized vessels. The dyeing process is carried out when dyestuff cycles back and forth radially through the core and through the yarn wound thereon.

Resiliently collapsible, or compressible, spring dye tubes provide the advantage that a greater amount of yarn can be placed in the dye kettle for dyeing during a single cycle. This is a result of the ability of each spring dye tube on a stack about a given spindle to be collapsed or axially compressed to some degree.

At the present time, spring dye tubes of this type are largely molded from thermoplastic materials, and can be produced in large numbers quite economically. Generally, they are used once and discarded, thus obviating the former necessity to clean stainless steel dye springs thoroughly between successive uses in order to avoid contaminating later dyeing cycles with trace amounts of previously used dye.

The present invention is primarily directed toward problems typically encountered during the winding cycle, that is, the manufacturing step wherein the yarn is wound onto the spring dye tube before dyeing. The winding itself is carried out at high speeds. This often causes an axial lengthening, or growth, of the tube as a whole to occur. The tubes may also be compressed during winding depending on the angle at which the yarn is wound thereonto. In either case, such structural instability could render it impossible to properly stack the spring dye tubes within the kettle for dyeing. The present invention provides a solution to these often frustrating problems, because it includes a membrane-like stabilizing member which inhibits both compression and elongation during the winding cycle.

SUMMARY OF THE INVENTION

Accordingly, the present invention is a spring dye tube having the form of an open-ended cylinder with a latticed side wall. Textile yarns to be dyed are wound at high speeds onto the outer surfaces of the spring dye tubes. The tubes of the present invention have the necessary structural stability to resist deformation during high-speed winding, yet remain resiliently compressible in a longitudinal, or axial, direction.

In one embodiment of the present invention, the spring dye tubes include two end rings, and a number of intermediate rings. These rings are disposed in such a way that their centers fall along a common axis, which is the axis of the cylindrical spring dye tube itself.

The end rings are connected by a number of substantially longitudinal ribs, having a configuration designed to permit the resilient collapse of the tube. One such configuration is a zig-zag rib of straight segments defining a series of apexes. Each such rib has an equal number of apexes, falling on the intermediate rings disposed between the end rings. Together, the end and intermediate rings, joined by the substantially longitudinal ribs, form a resiliently collapsible, cylindrical lattice. Advantageously, the end rings have edges perpendicular to the latticed side wall surface to enable the spring dye tubes to be stacked one atop another in the pressurized vats where the dying process is carried out.

At each end of the spring dye tube of the present invention may be an end zone composed of a number of longitudinal members extending from each of the end rings in a direction away from the substantially longitudinal ribs. The longitudinal members of the end zones extend to ring-like end rims. Where the tube includes such end zones, the end rims have edges perpendicular to the latticed side wall surface to enable the spring dye tubes to be stacked one atop another in the pressurized vats where the dyeing process is carried out. The end zones may or may not be collapsible, as desired.

Finally, the spring dye tubes of the present invention include a plurality of membrane-like longitudinally extending stabilizing elements. These elements distinguish the present tub from those of the prior art by virtue of their being wider in a direction transverse to the length of the tube than they are thick in a direction radially outward from the axis of the tube. As a consequence of this feature, these elements will buckle in radial directions with respect to the cylindrical tube, instead of in transverse or circumferential directions, when the tube is compressed in an axial direction.

The longitudinal stabilizing elements are found adjacent to the inner surface of the spring dye tube, and may be thin membranes integrally connected to the substantially longitudinal ribs, and intermediate and end rings. On the other hand, the longitudinal stabilizing elements may be separated from the substantially longitudinal ribs, since, depending upon the application, it may be advantageous to provide them centered between the substantially longitudinal ribs. Moreover, these elements may be provided in pairs separated by a small gap, permitting dye liquor to flow freely therethrough. Alternatively, the longitudinal stabilizing elements may be provided with a longitudinally extending groove. When such a tube is subjected to longitudinal compression, ensuing stresses within the longitudinal stabilizing elements will cause splitting along the grooves, and produce additional openings for the passage of the dye solution. Circular or oval holes through the longitudinal stabilizing elements may be provided to serve the same purpose as a groove. Whether a gap, a groove, or holes are chosen, they advantageously extend longitudinally between an adjacent pair of substantially longitudinal ribs.

In still another embodiment, the longitudinal stabilizing elements may be provided without longitudinally extending grooves. In this embodiment, such a longitudinal stabilizing element is preferably not as wide as the space between an adjacent pair of substantially longitudinal ribs, so that it will not completely fill the openings therebetween through the latticed side wall of the cylindrical spring dye tube.

In yet another embodiment, the longitudinal stabilizing element may be a single thin membrane covering the entire inner surface of the spring dye tube, and integrally connected to the substantially longitudinal ribs, and to the intermediate and end rings. In such an embodiment, the longitudinal stabilizing element may be provided with a plurality of perforations, comprising circular or oval holes, through those portions of the longitudinal stabilizing element covering the lattice-like openings between the substantially longitudinal ribs, and intermediate and end rings.

The membrane-like longitudinal stabilizing elements of the present invention may also be included in the design of helical dye springs. Such a spring dye tube, for example, also has the form of an open-ended cylinder with a latticed side wall having an inner surface and an outer surface. It includes a first end ring and a second end ring, each of which has an edge perpendicular to the latticed side wall of the spring dye tube, so that a number of spring dye tubes may be stacked one atop another.

The helical spring dye tube of the present invention includes at least one helical member extending from the first end ring to the second end ring. Each helical member has a plurality of turns, all centered upon and sharing a common axis with said first end ring and said second end ring. It also includes a plurality of longitudinal members, each of which extends between a pair of adjacent turns of the helical members. Each longitudinal member is separated from others of its kind in both the helical and longitudinal directions on the spring dye tube. Finally, the helical spring dye tube includes the longitudinal stabilizing elements described previously above.

The spring dye tube of the present invention will now be more completely and particularly described with reference to a series of figures, which may be briefly identified as follows.

BRIEF DESCRIPTION OF THE DRAWINGS

FIG. 3 shows a side view of the embodiment shown in FIG. 1 following the application of a compressive force thereto in a longitudinal direction.

FIG. 4 is a cross section of the spring dye tube, taken at the line 4–4 in FIG. 3.

FIG. 5 shows a partial side view of an alternate embodiment of the spring dye tube of the present invention.

FIG. 6 is a cross section of the alternate embodiment of the spring dye tube taken at the line 6—6 in FIG. 5.

DESCRIPTION OF THE PREFERRED EMBODIMENT

Figure 1:
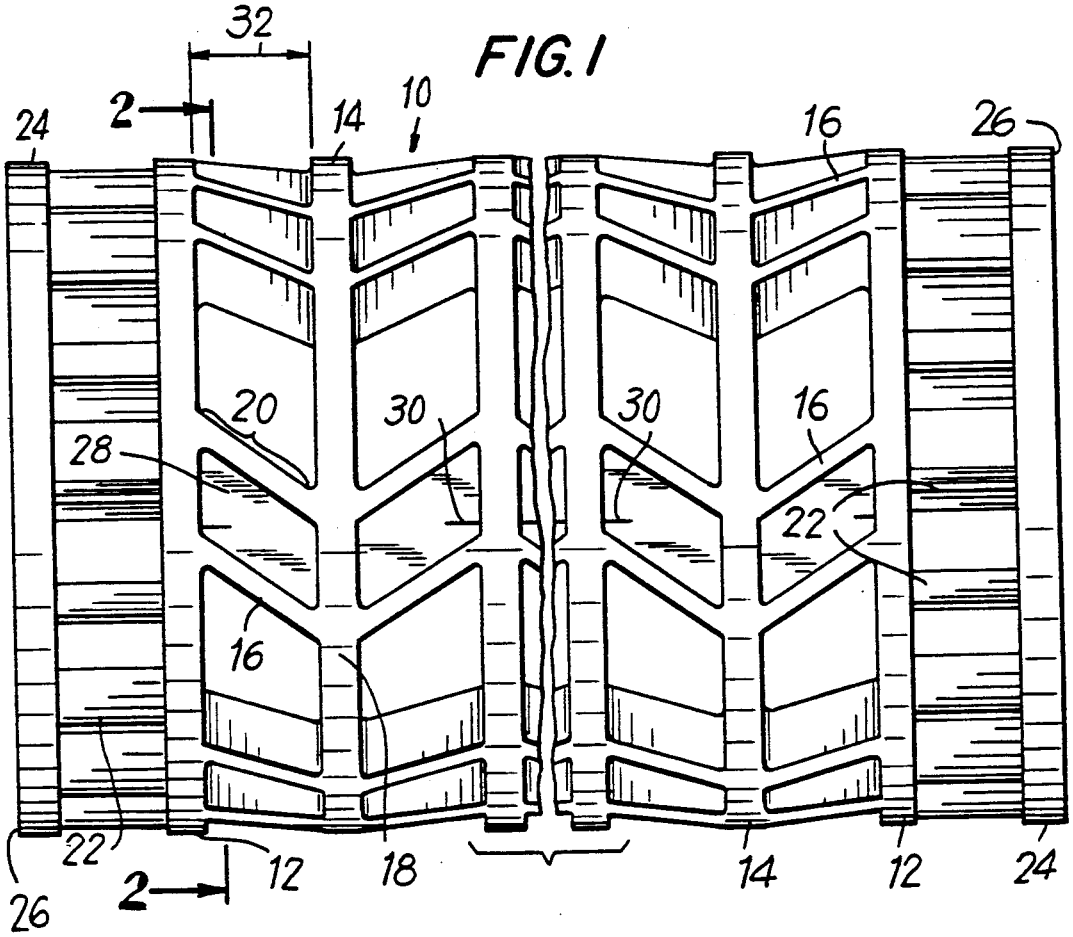
FIG. 1 shows a side view of one embodiment of the spring dye tube of the present invention.

Turning now to the figures, an embodiment of the spring dye tube 10 of the present invention is shown in FIG. 1. The spring dye tube 10 is typically an integral, or one-piece, structure molded from a flexible polymeric resin material such as polypropylene, polyethylene, or polybutylene. Materials that might be used in very special applications are polyformaldehyde (acetal) and polyethylene teraphthalate (PET). Other flexible thermoplastic materials than those mentioned may also find use in the production of the tubes.

The spring dye tubes 10 of the present invention have two end rings 12, and a plurality of intermediate rings 14. The end rings 12 and intermediate rings 14 are circular having substantially equal inner radius and are centered on a common axis, the axis of the cylindrical spring dye tube 10.

Extending from one end ring 12 to the other are a plurality of substantially longitudinal ribs 16. In the embodiment shown in FIG. 1, each substantially longitudinal rib 16 is composed of a number of straight segments 20 in a zig-zag configuration characterized by a plurality of apexes 18. Each apex 18 falls on an intermediate ring 14 and, as a consequence, each substantially longitudinal rib 16 has an equal number of apexes 18 as there are intermediate rings 14. Further, in the embodiment shown in FIG. 1, all the apexes 18 on a given one of the intermediate rings 14 point in a common direction about the spring dye tube 10. The apex-forming straight segments 20 of the substantially longitudinal ribs 16 produce the impression of a plurality of V-shapes, reminiscent of chevrons, on the surface of the spring dye tube 10. Alternatively, the surface of the spring dye tube 10 can be said to have a plurality of parallelogram-shaped openings.

Figure 7:
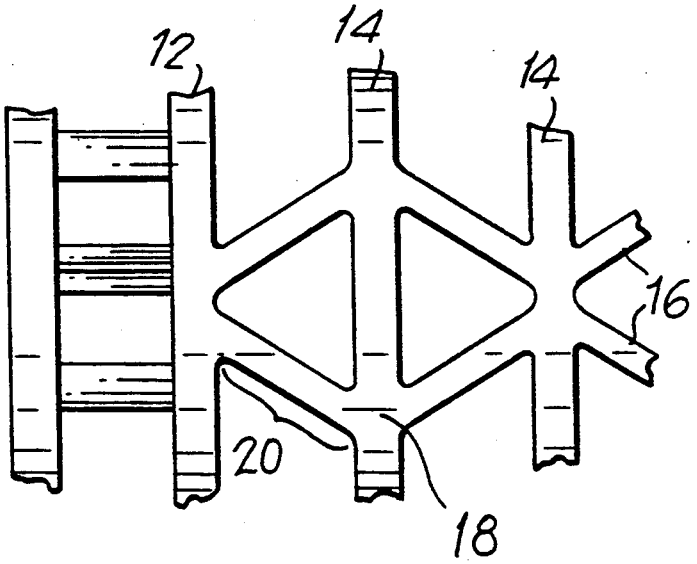
FIG. 7 shows a partial side view of another embodiment of the spring dye tube of the present invention.

In an alternate embodiment, shown in FIG. 7, all apexes 18 on a given one of the intermediate rings 14 do not point in a common direction about the spring dye tube 10. Some apexes 18 may point in one direction, while other apexes 18 may point in the opposite direction. In this embodiment, the straight segments 20 of each substantially longitudinal rib 16 between a given adjacent pair of intermediate rings 14 are not all parallel to one another, in order to provide a greater degree of stiffness to the spring dye tube 10. As consequence, some or all of the openings through the latticed side wall of spring dye tube 10 are triangular or trapezoidal, instead of parallelogram-shaped.

The segments 20, end rings 12, intermediate rings 14, and, it would follow, the substantially longitudinal ribs 16 may have rectangular cross sections. The substantially longitudinal ribs 16 can be disposed in groups of more than one about the spring dye tube 10.

At each end of the spring dye tube 10 in FIG. 1 is an end zone which includes longitudinal members 22 and an end rim 24. The end zones, composed of longitudinal members 22 and end rims 24, can be collapsible or non-collapsible, as desired. The end rims 24 can be of rectangular cross section, while the longitudinal members 22 can have triangular cross sections with apexes residing on the outer surface of the spring dye tube 10, that is, pointing radially outward from the tube axis. The edges 26 of the end rims 24 are perpendicular to the longitudinal axis of the spring dye tube 10, that is, perpendicular to its outer surface, so that the tubes may be stacked one atop another.

Also shown in FIG. 1 is a longitudinal stabilizing element 28, visible between a pair of adjacent substantially longitudinal ribs 16 and extending substantially from one end ring 12 to the other. The longitudinal stabilizing element 28 is wider in the transverse direction than it is thick in a radial direction. It is characterized by a longitudinal groove 30 located on the longitudinal stabilizing element 28 and running between a pair of the substantially longitudinal ribs 16.

Before leaving a discussion of FIG. 1, it is important to note, for the purpose of making a comparison below, the double-headed arrow 32 which indicates the distance between an end ring 12 and an intermediate ring 14 in an uncollapsed spring dye tube 10.

Figure 2:
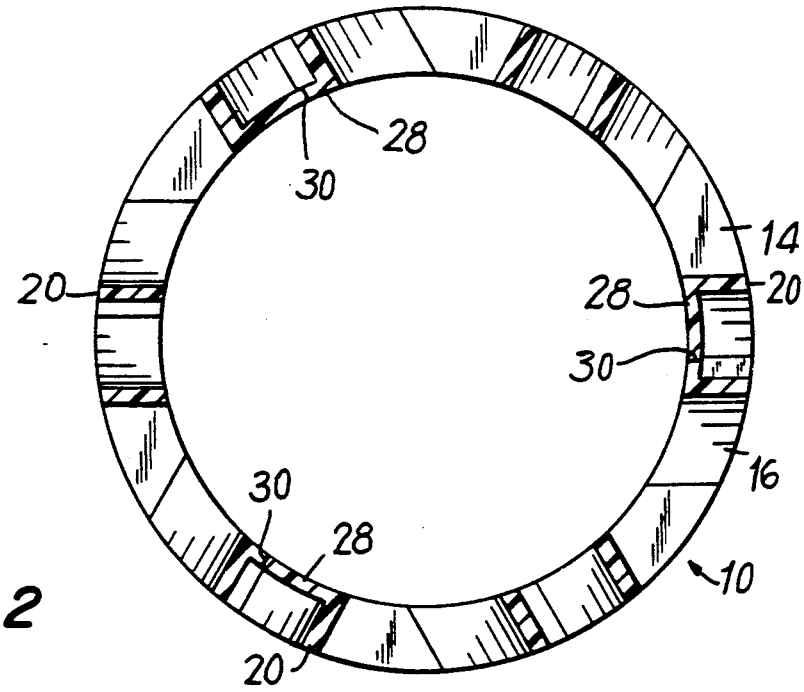
FIG. 2 is a cross section of the spring dye tube, taken at the line 2—2 in FIG. 1.

Turning now to FIG. 2, a cross section taken at the line 2—2 in FIG. 1, it can be seen that the segments 20 of the substantially longitudinal ribs 16 are of rectangular cross section. It can also be seen that the substantially longitudinal ribs 16 are disposed in groups of two, which are closer to each other than either is to those of adjacent groups. In a spring dye tube 10 of larger diameter than that shown in FIG. 2, the substantially longitudinal ribs 16 may be disposed in groups of more than two ribs 16. In such case, those within a given group are closer to one another than the distance from one group to the next.

Also shown in cross section in FIG. 2 are the longitudinal stabilizing elements 28, which reside adjacent to the inner surface of the spring dye tube 10. In the view presented, it is readily apparent that they are of substantially greater width than thickness, as measured radially from the axis of the spring dye tube 10. Also shown is the groove 30 which enables a longitudinal stabilizing element 28 to split when the spring dye tube 10 as a whole is compressed. The groove 30 can also be seen to lie between two adjacent substantially longitudinal ribs 16.

In FIG. 3, a compressed example of the embodiment of the spring dye tube 10 shown in FIG. 1 is presented. Note, first, the double-headed arrow 34, indicating the distance between end ring 12 and intermediate ring 14, is shorter than that shown in FIG. 1 and indicates, at least qualitatively, the degree of collapse of the spring dye tube 10.

In this instance, the longitudinal members 22 in the end zones have buckled, as suggested by the oblique angles they form with the end rings 12 and end rims 24. This, however, is not a necessary consequence of longitudinal compression on the spring dye 10, as a non-buckling end zone is among the possible characteristics of a spring dye tube 10 made in accordance with the present invention.

As a consequence of the longitudinal compression, the substantially longitudinal ribs 16 have acquired the appearance of a series of connected S-curves. More importantly, the longitudinal stabilizing element 28 has buckled and split along the groove 30 producing a series of openings 36 between a pair of substantially longitudinal ribs 16. The openings 36 permit the passage of dye therethrough when the spring dye tube 10 of the present invention is put to its intended use in dyeing textile yarn.

In FIG. 4, a partial cross section of the collapsed spring dye tube 10 in FIG. 3 is shown and was taken at the point indicted by line 4—4 therein. As can be seen in FIG. 4, particularly when compared to FIG. 2, the longitudinal stabilizing element 28 has buckled radially outward, splitting same along the groove 30 and forming the opening 36.

An alternate embodiment of the present invention is shown in FIG. 5. There, the longitudinal stabilizing elements 28 are provided in pairs, each said pair being separated by a gap 38. The gap 38 extends longitudinally along the spring dye tube between a pair of adjacent substantially longitudinal ribs 16. When this embodiment of the spring dye tube 10 is compressed, the longitudinal stabilizing elements 28 will buckle radially as suggested by FIG. 4, and the gap 38 will provide a series of openings 36 without the need for splitting along a groove 30.

FIG. 6 is a cross section taken along line 6—6 in FIG. 5 and shows a pair of longitudinal stabilizing elements 28, each of greater width than thickness, as measured transversely and radially, respectively, separated by a gap 38.

Figure 8:
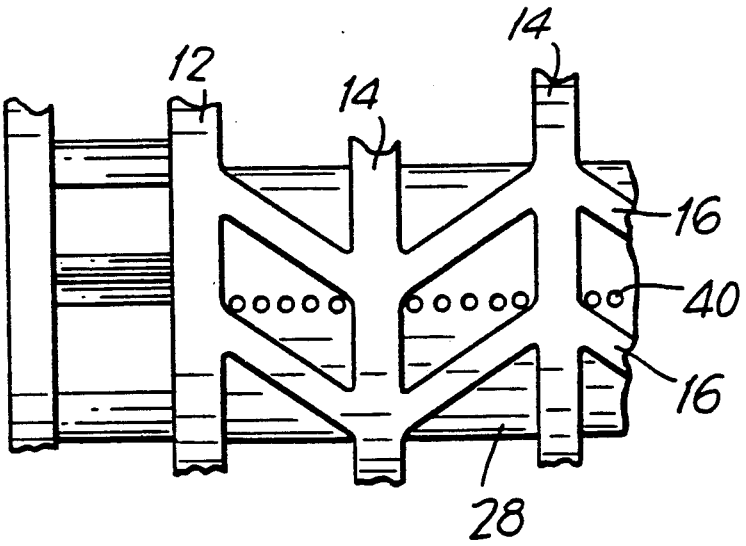
FIG. 8 shows a partial side view of still another embodiment of the spring dye tube of the present invention.

In FIG. 8 is depicted a further embodiment of the present invention wherein the groove 30 in the longitudinal stabilizing element 28 has been replaced by a longitudinal line of holes 40 to provide stress relief points to split the longitudinal stabilizing element 28 when the spring dye tube 10 is compressed longitudinally.

Figure 9:
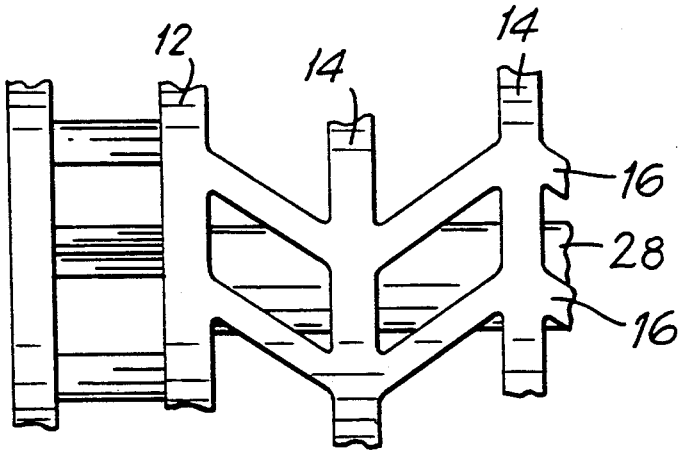
FIG. 9 shows a partial side view of yet another embodiment of the spring dye tube of the present invention.

In FIG. 9 is depicted yet another embodiment of the present invention wherein the longitudinal stabilizing element 28 has no groove 30, gap 38, or longitudinal line of holes 40. In this embodiment, the longitudinal stabilizing element 28 preferably will not occupy the entire space between a pair of adjacent longitudinally extending ribs 16.

Figure 10:
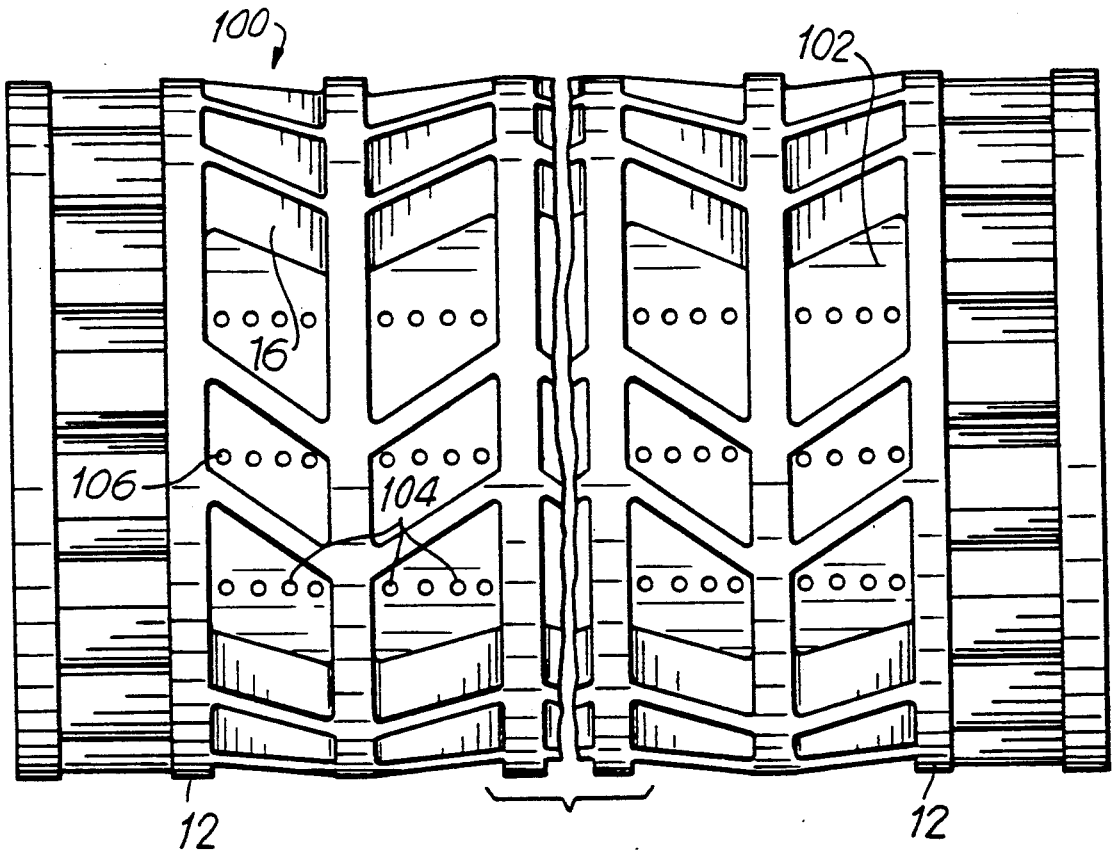
FIG. 10 shows a side view of a further embodiment of the spring dye tube of the present invention.

Turning now to FIG. 10, a further embodiment of the spring dye tube of the present invention has much the same appearance as that shown in FIG. 1. However, upon closer inspection, this spring dye tube 100 has a longitudinal stabilizing element 102 which substantially covers the inner surface of the tube 100 between the end rings 12. As shown in FIG. 10, longitudinal stabilizing element 102 is provided with a plurality of perforations 104. As previously discussed, the perforations 104 provide stress relief points to split the longitudinal stabilizing element 102 when the spring dye tube 100 is compressed in a longitudinal direction. In this way, openings will be produced to permit dye to pass therethrough between the inner and outer surfaces of the spring dye tube during use. Advantageously, the plurality of perforations 104 are arrayed in a plurality of longitudinal lines 106, each said line 106 being located between an adjacent pair of substantially longitudinal ribs 16.

Figure 11:
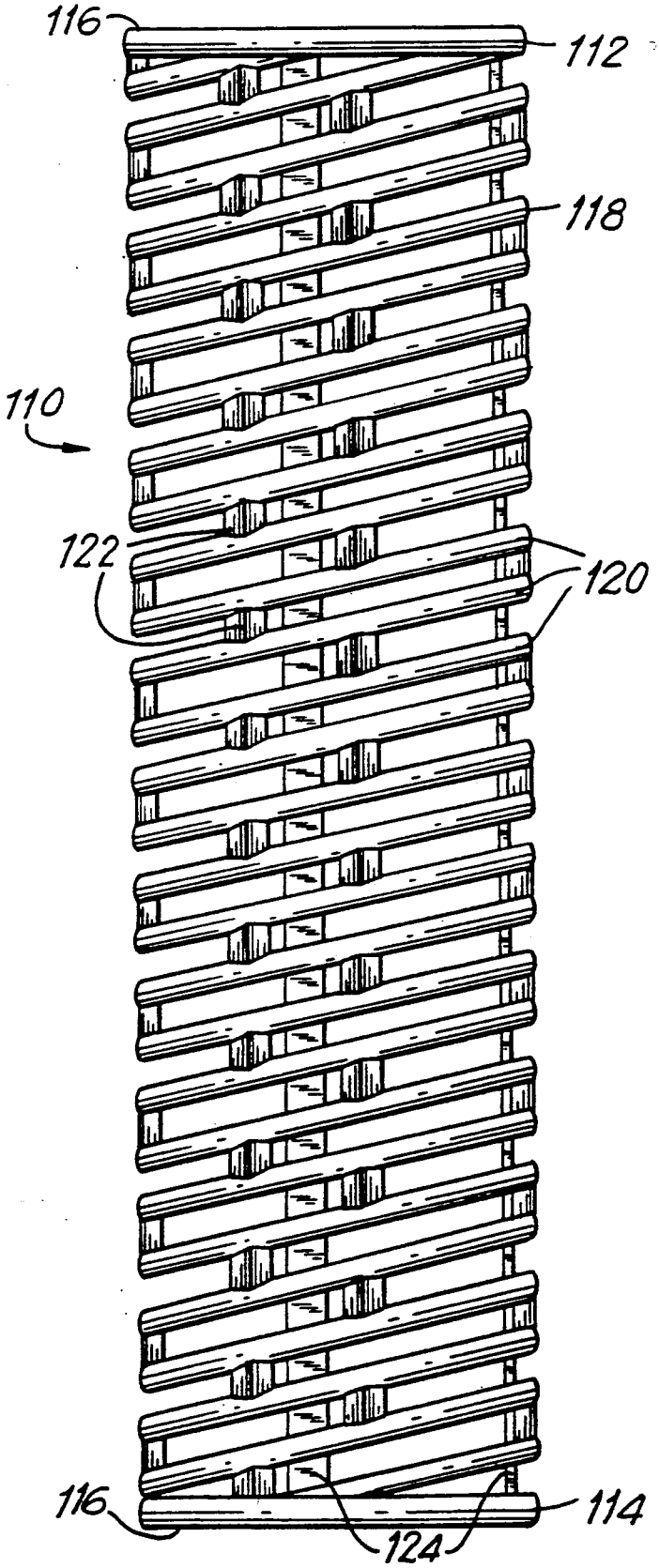
FIG. 11 shows a side view of a helical spring dye tube incorporating the longitudinal stabilizing elements of the present invention.

In FIG. 11, a helical spring dye tube 110 which includes the longitudinal stabilizing element of the present invention is shown. As before, the helical spring dye tube 110 takes the form of an open-ended cylinder with a latticed side wall, having an inner surface and an outer surface.

The helical spring dye tube 110 includes a first end ring 112 and a second end ring 114. Each of these end rings 112, 114 has an edge 116, which is perpendicular to the latticed side wall of the helical spring dye tube 110, so that a number of such spring dye tubes may be stacked one atop another.

Also included in helical spring dye tube 110 is at least one helical member 118 extending from the first end ring 112 to the second end ring 114. Helical member 118 includes a plurality of turns 120, each of which is centered upon and shares a common axis with first end ring 112 and second end ring 114.

There are further a plurality of longitudinal members 122, each of which extends between an adjacent pair of turns 120 of the at least one helical member 118. As shown in FIG. 11, each of the plurality of longitudinal members 122 is separated from neighboring longitudinal members 122 in both the helical and longitudinal directions, to permit the helical spring dye tube 110 to collapse in the longitudinal direction in response to a compressive force.

Finally, helical spring dye tube 110 includes at least one longitudinal stabilizing element 124 of the variety previously described. That is, the longitudinal stabilizing element 124 is adjacent to the inner surface of the tube 110, and extends substantially from the first end ring 112 to the second end ring 114. As before, the longitudinal stabilizing element 124 has a width dimension, measured transversely on helical spring dye tube 110, greater than a thickness dimension, measured radially from the common axis of the at least one helical member 118, and of the first end ring 112 and the second end ring 114. When the helical spring dye tube 110 is subjected to compression in a longitudinal direction, the longitudinal stabilizing elements 124 will buckle in a radial direction.

Figure 12:
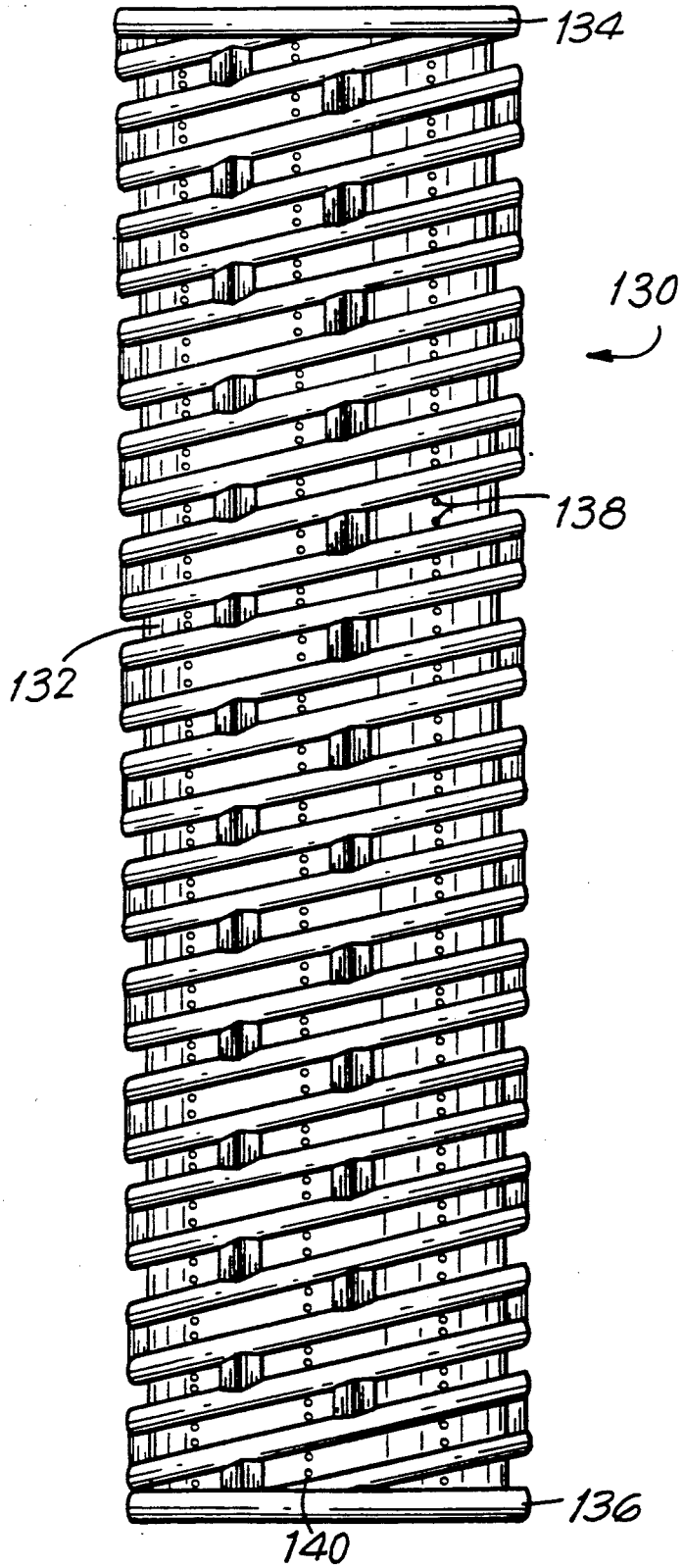
FIG. 12 shows an alternate embodiment of the helical spring dye tube depicted in FIG. 11.

With reference now to FIG. 12, there is shown an alternate embodiment of the helical spring dye tube shown in FIG. 11. In FIG. 12, helical spring dye tube 130 has a longitudinal stabilizing element 132 which substantially covers the inner surface of the tube 130 between the first end ring 134 and the second end ring 136. As shown in FIG. 12, longitudinal stabilizing element 132 is provided with a plurality of perforations 138. As before, the perforations 138 provide stress relief points to split the longitudinal stabilizing element 132 when the helical spring dye tube 130 is compressed in a longitudinal direction. In this way, openings will be produced to permit dye to pass therethrough between the inner and outer surfaces of the spring dye tube during use. Advantageously, the plurality of perforations 138 are arrayed in a plurality of longitudinal lines 140.

Modifications to the above would be obvious to one skilled in the art without departing from the scope of the invention as defined in the appended claims.

What is claimed is:

1. A spring dye tube having the form of an open-ended cylinder with a latticed side wall, said latticed side wall having an inner surface and an outer surface, comprising:

a first end ring and a second end ring, each said end ring having an edge perpendicular to said latticed side wall of said spring dye tube, so that said spring dye tubes may be stacked one atop another;

a plurality of intermediate rings disposed between said first end ring and said second end ring, said intermediate rings centered upon and sharing a common axis with said first end ring and said second end ring;

a plurality of substantially longitudinal ribs extending from said first end ring to said second end ring and integrally connected therewith, each of said substantially longitudinal ribs having a zig-zag configuration formed of a plurality of segments and defining a plurality of apexes, said plurality of apexes being equal in number to said plurality of intermediate rings, and each of said plurality of apexes being on one of said intermediate rings; and at least one longitudinal stabilizing element adjacent to said inner surface of said latticed side wall, said at least one longitudinal stabilizing element being a thin membrane extending substantially from said first end ring to said second end ring and having a width dimension, measured transversely on said spring dye tube, greater than a thickness dimension, measured radially from said common axis of said plurality of intermediate rings, so that said at least one longitudinal stabilizing element will buckle in a radial direction when said spring dye tube is compressed in a longitudinal direction.

2. A spring dye tube a claimed in claim 1 further comprising:

a first end zone and a second end zone, said end zones being integrally connected to said first end ring and said second end ring respectively, said end zones having a plurality of longitudinally members extending from its respective end ring and away from said plurality of substantially longitudinal ribs to a respective end rim, each said end rim having an edge perpendicular to said latticed side wall of said spring dye tube, so that said spring dye tubes can be stacked one atop another.

3. A spring dye tube as claimed in claim 2 wherein one of said plurality of longitudinal members in one of said first and second end zones has a triangular cross section with an apex directed away from said common axis of said plurality of intermediate rings and residing adjacent to said outer surface of said latticed side wall of said spring dye tube.

4. A spring dye tube as claimed in claim 2 wherein said plurality of longitudinal members in said first and second end zones are of greater length than the longitudinal distance between each of said plurality of intermediate rings.

5. A spring dye tube as claimed in claim 2 wherein each of said first end rim and said second end rim has a substantially rectangular cross section.

6. A spring dye tube as claimed in claim 2 wherein one of said first end zone and said second end zone is rigid and resists collapse under a compressive force delivered in the longitudinal direction of said spring dye tube.

7. A spring dye as claimed in claim 1 wherein said plurality of intermediate rings and said plurality of substantially longitudinal ribs define together a plurality of parallelogram-shape openings in said latticed side wall of said spring dye tube.

8. A spring dye tube as claimed in claim 1 wherein one of said plurality of intermediate rings has a substantially rectangular cross section.

9. A spring dye tube as claimed in claim 1 wherein one of said first end ring and said second end ring has a substantially rectangular cross section.

10. A spring dye tube as claimed in claim 1 wherein one of said plurality of substantially longitudinal ribs has a substantially rectangular cross section.

11. A spring dye tube as claimed in claim 1 wherein said plurality of substantially longitudinal ribs is formed of a plurality of straight segments which produce a pattern of chevrons on said latticed side wall of said spring dye tube.

12. A spring dye tube as claimed in claim 1 wherein said plurality of intermediate rings have alternating different thicknesses measured longitudinally along said spring dye tube.

13. A spring dye tube as claimed in claim 1 wherein said plurality of substantially longitudinal ribs are disposed in equal intervals on the latticed side wall of said spring dye tube.

14. A spring dye tube as claimed in claim 1 wherein said plurality of substantially longitudinal ribs are disposed in a plurality of groups, each said group having at least two substantially longitudinal ribs.

15. A spring dye tube as claimed in claim 1 wherein said plurality of apexes on one of said plurality of intermediate rings point in a common direction about said latticed side wall of said spring dye tube.

16. A spring dye tube as claimed in claim 1 wherein at least one of said plurality of apexes on one of said plurality of intermediate rings points in one direction about said latticed side wall of said spring dye tube, and at least one of said plurality of apexes on the same one of said plurality of intermediate rings points in an opposite direction about said latticed side wall of said spring dye tube.

17. A spring dye tube as claimed in claim 1 wherein said tube is composed of polymeric material selected from the group consisting of polypropylene, polyethylene, and polybutylene.

18. A spring dye tube as claimed in claim 1 having two said longitudinal stabilizing elements, said longitudinal stabilizing elements being disposed in a pair on said spring dye tube, each said longitudinal stabilizing element of said pair separated from the other of said pair by a longitudinal gap, said gap running longitudinally between a pair of adjacent substantially longitudinal ribs, so that dye may pass therethrough between said inner surface and said outer surface of said spring dye tube during use.

19. A spring dye tube as claimed in claim 1 wherein said at least one longitudinal stabilizing element has a longitudinal groove, said groove running longitudinally on said longitudinal stabilizing element between a pair of adjacent substantially longitudinal ribs, said groove providing a stress relief point to split said longitudinal stabilizing element when said spring dye tube is compressed in a longitudinal direction, openings being thereby produced so that dye may pass therethrough between said inner surface and said outer surface of said spring dye tube during use.

20. A spring dye tube as claimed in claim 1 wherein said at least one longitudinal stabilizing element has a longitudinal line of holes, said longitudinal line of holes running longitudinally on said longitudinal stabilizing element between a pair of adjacent substantially longitudinal ribs, said holes providing stress relief points to split said longitudinal stabilizing element when said spring dye tube is compressed in a longitudinal direction, openings being thereby produced so that dye may pass therethrough between said inner surface and said outer surface of said spring dye tube during use.

21. A spring dye tube as claimed in claim 1 wherein said at least one longitudinal stabilizing element covers said inner surface of said spring dye tube substantially from said first end ring to said second end ring, said longitudinal stabilizing element having a plurality of perforations to provide stress relief points to split said longitudinal stabilizing element when said spring dye tube is compressed in a longitudinal direction, openings being thereby produced so that dye may pass therethrough between said inner surface and said outer surface of said spring dye tube during use.

22. A spring dye tube as claimed in claim 21 wherein said plurality of perforations are arranged in a plurality of longitudinal lines, each of said plurality of longitudinal lines running longitudinally on said longitudinal stabilizing element between an adjacent pair of substantially longitudinal ribs.

23. A spring dye tube having the form of an open-ended cylinder with a latticed side wall, said latticed side wall having an inner surface and an outer surface, comprising:

a first end ring and a second end ring, each of said end rings having an edge perpendicular to said latticed side wall of said spring dye tube, so that said spring dye tubes may be stacked one atop another;

at least one helical member extending from said first end ring to said second end ring, said at least one helical member having a plurality of turns, said turns being centered upon and sharing a common axis with said first end ring and said second end ring;

a plurality of longitudinal members, each said longitudinal member extending between a pair of turns of said at least one helical member, each of said plurality of longitudinal members being separated from others of said plurality of longitudinal in both helical and longitudinal directions on said spring dye tube; and at least one longitudinal stabilizing element adjacent to said inner surface of said latticed side wall, said at least one longitudinal stabilizing element extending substantially from said first end ring to said second end ring, and having a width dimension, measured transversely on said spring dye tube, greater than a thickness direction, measured radially from said common axis of said at least one helical member and said first end ring and said second end ring, so that said at least one longitudinal stabilizing element will buckle in a radial direction when said spring dye tube is compressed in a longitudinal direction.

24. A spring dye tube as claimed in claim 23 wherein said at least one longitudinal stabilizing element covers said inner surface of said spring dye tube substantially from said first end ring to said second end ring, said longitudinal stabilizing element having a plurality of perforations to provide stress relief points to split said longitudinal stabilizing element when said spring dye tube is compressed in a longitudinal direction, openings being thereby produced so that dye may pass therethrough between said inner surface and said outer surface of said spring dye tube during use.

25. A spring dye tube as claimed in claim 24 wherein said plurality of perforations extend in a plurality of longitudinal lines running longitudinally on said longitudinal stabilizing element substantially from said first end ring to said second end ring.

* * * * *